United States Patent [19]

Nishida

[11] Patent Number: 5,042,283

[45] Date of Patent: Aug. 27, 1991

[54] ALUMINUM TUBE MANUFACTURING DEVICE

[75] Inventor: Hirotaka Nishida, Osaka, Japan

[73] Assignee: Taisei Kako Co., Osaka, Japan

[21] Appl. No.: 427,889

[22] Filed: Oct. 30, 1989

[51] Int. Cl.[5] ..... B21C 23/18; B21C 26/00

[52] U.S. Cl. ..... 72/267; 72/273

[58] Field of Search ..... 72/267, 273

[56] References Cited

U.S. PATENT DOCUMENTS

| | | | |
|---|---|---|---|
| 2,099,449 | 11/1937 | Metzger | 72/267 |
| 2,979,195 | 4/1961 | Martin | 72/267 |
| 4,321,816 | 3/1982 | Nakahara et al. | 72/267 |

FOREIGN PATENT DOCUMENTS

| | | | |
|---|---|---|---|
| 897580 | 3/1945 | France | 72/267 |

*Primary Examiner*—Robert L. Spruill

*Attorney, Agent, or Firm*—Lowe, Price, LeBlanc and Becker

[57] ABSTRACT

An aluminum tube manufacturing device is provided that includes a female die having an internal shape identical with an external shape of an upper part of an aluminum tube to be formed thereby, including a mouth portion, a shoulder portion and a portion of a drum part of the tube. A punch having an external shape identical with the internal shape of the upper part of the tube that is to be formed forcibly extrudes the aluminum tube by applying pressure to a ring-shaped element of aluminum material loaded in the female die. A corner portion of the female die which joins the shoulder portion with the drum portion in the internal shape of the female die is formed as a smooth arc, and the punch is formed to have a maximum diameter portion thereof approaching a vertical internal surface of the drum portion below the arc-shaped corner portion of the female die when the punch is being pressed into the female die. The shoulder portion of the female die and the shoulder portion of the punch are formed to coact such that a space there between is maximized adjacent the maximum diameter portion of the punch.

2 Claims, 4 Drawing Sheets

ALUMINUM TUBE MANUFACTURING DEVICE

FIELD OF THE INVENTION

The present invention relates to an aluminum tube manufacturing device and particularly pertains to an improvement in a device for press-forming an aluminum tube by loading a ring shape aluminum material in a female die having an internal shape identical with the external shape of the tube upper part including the mouth portion, shoulder portion as well as a portion of the drum part of the tube to be formed and, then, pressing it with a punch.

BACKGROUND OF THE PRIOR ART

Among conventional devices of this type there is known a device composed of a female die, best seen in FIGS. 5 and 6 having an internal shape identical with the external shape of the tube upper part including the mouth portion, shoulder portion as well as a portion of the drum part of the tube to be formed and a punch 02 to be pressed into this female die. According to this method a ring-shaped aluminum material 03 element, after being loaded in the female die, is extended by pressing the punch 02 thereinto, thereby press-forming an aluminum tube. The load imposed on the female die and the punch at this press-forming time is very large; on this account, the part 01A of the female die corresponding to the drum part has hitherto been formed of a sintered hard alloy, and the other part 01B is made of quenched SKD-11 which is relatively low-priced and highly and serves as a disposable part. This not only makes the structure of the female die complex, but causes the price to rise. A factor in the large value of the load at the time of forming above-described is attributed to the flow of the aluminum. Thus as the punch 02 is pressed in, the aluminum is extruded to form the tube drum part, being pressed by the maximum diameter portion 02*a* under the shoulder portion of the punch 02. At this time, the aluminum placed above of the maximum diameter portion 02*a* receives an extraordinary compression and this pressure is exerted on the female die and the punch.

SUMMARY OF THE INVENTION

Accordingly, it is a principal object of this invention not only to enable a quantity of aluminum to be smoothly extended and extruded at the time of the punch pressing in, thereby relieving the load imposed on the female die and the punch for prolonging the service life of every part, but to make it practical to integrally form the female die with a material like SKD-11, which is low-priced and is highly machineable, thereby reducing the cost of the overall device.

In order to achieve this object, the invention provides a construction such that in a device composed of a female die 4 having an internal shape identical with the external shape of the tube upper part including the mouth portion 1, shoulder portion 2 as well as a portion of the drum part 3 of a tube to be formed and a punch having an external shape identical with the internal shape of the tube upper part to be formed, for drawing-forming an aluminum tube A by extending a ring shape aluminum 6 loaded in the female die by way of pressing the aforementioned punch 5 into the female die, a corner portion 4*c* which joins a shoulder portion 4*a* with a drum part 4*b* in the internal shape of the aforementioned female die 4 is formed in a smooth arc; the aforementioned punch 5 is so formed as to have its maximum diameter portion 5*b* approaching the drum part 4*b* under the arc shape corner portion 4*c* of the aforementioned female die 4 in the state of the aforementioned punch 5 being pressed in the female die 4; and furthermore, the shoulder portion 4*a* of the aforementioned female die 4 and a shoulder portion 5*a* of the aforementioned punch 5 are so formed that a space therebetween is maximized at the part S, above the maximum diameter portion 5*b* of the aforementioned punch 5.

DESCRIPTION OF THE PREFERRED EMBODIMENT

The present invention is described in detail in connection with the preferred embodiment shown in FIG. 1 through 4.

Figure 1:
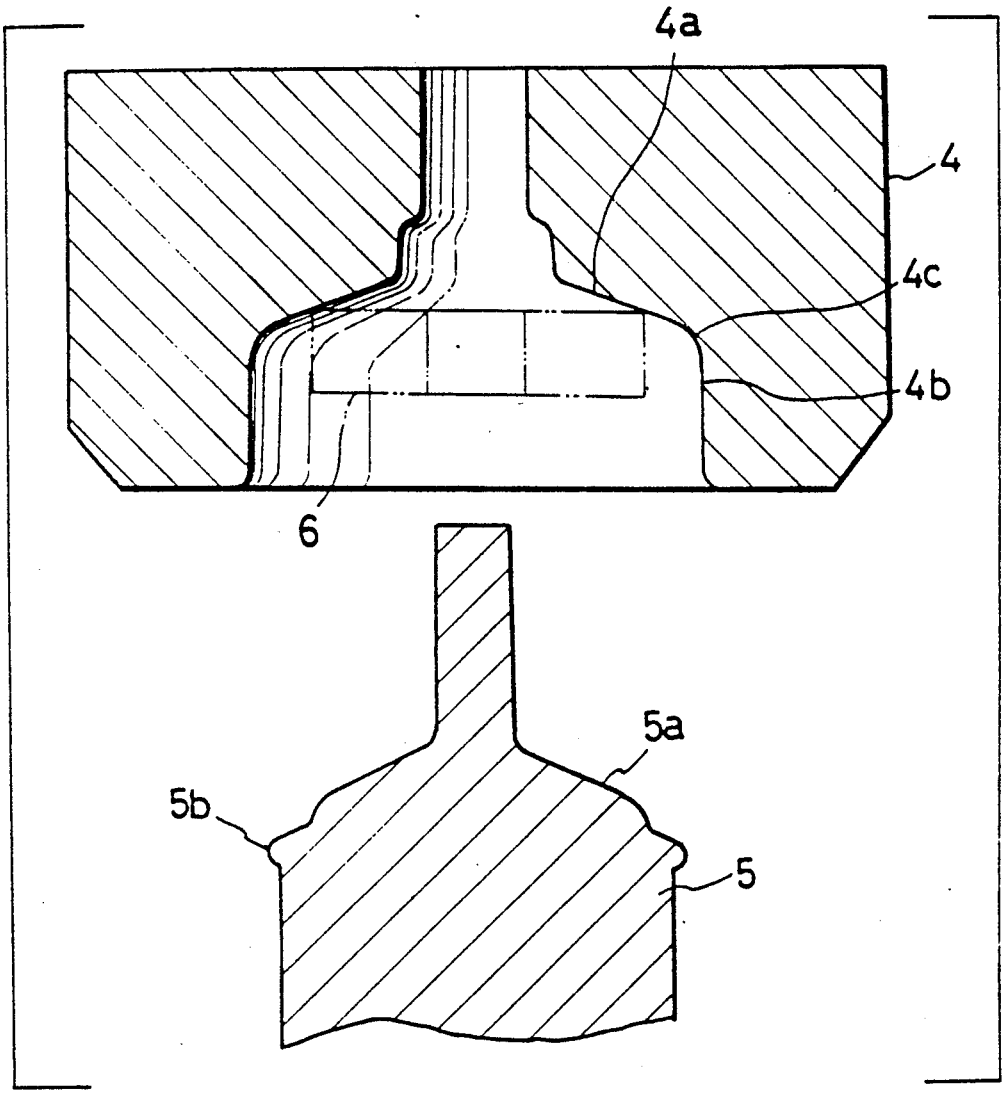
FIG. 1 is a sectional view of a device of this invention.
Figure 3:
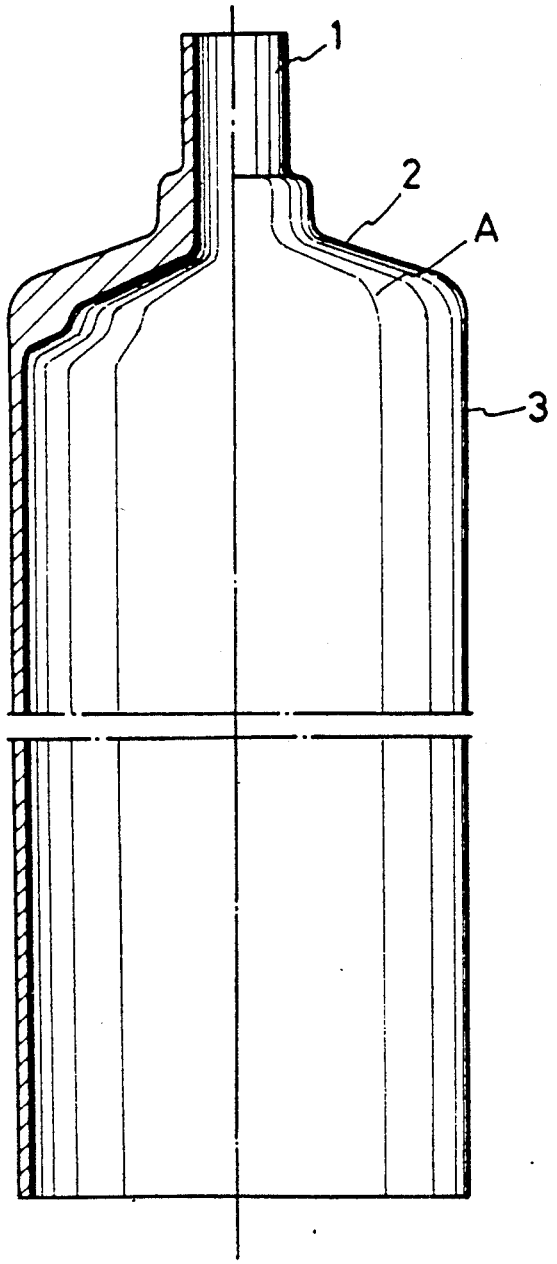
FIG. 3 is a partial sectional view of an aluminum tube manufactured by use of the device of this invention.
Figure 5:
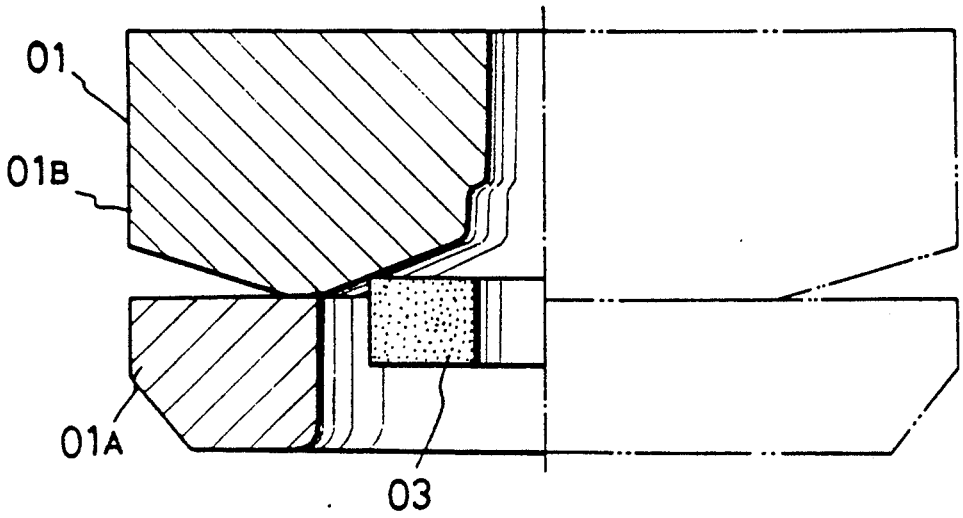
Fig.5 (PRIOR ART)
FIG. 5 and 6 are sectional views illustrating a known conventional device.
Figure 6:
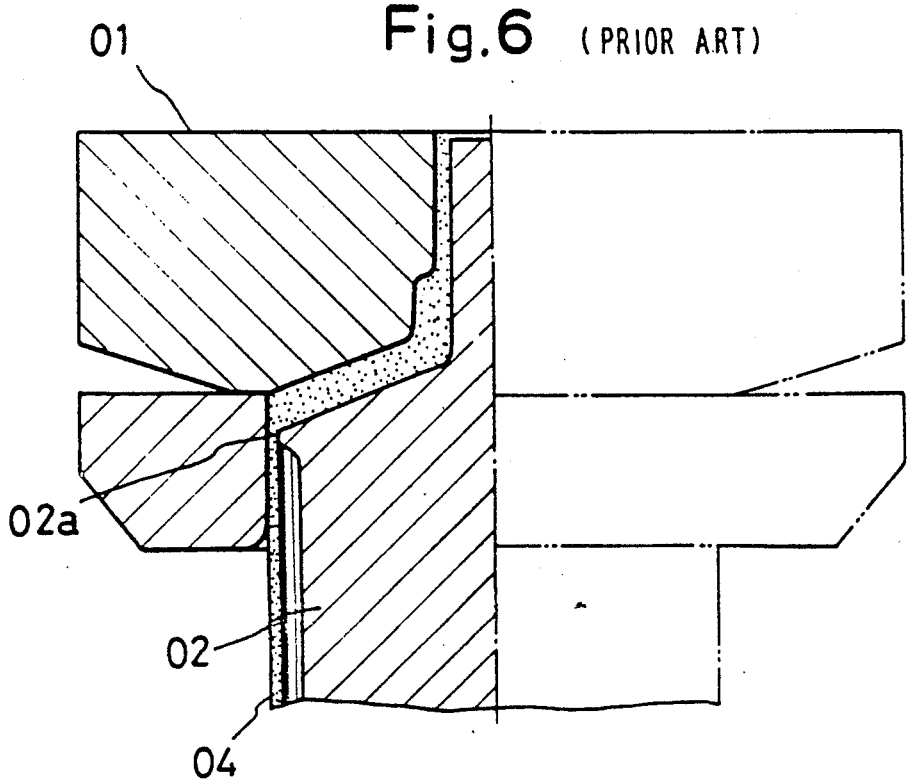
Fig.6 (PRIOR ART)

Referring to FIGS. 1 and 3, numeral 4 denotes a female die, which has an internal shape identical with the external shape of the tube upper part including the mouth portion 1, shoulder portion 2 and a portion of the drum part 3 of the tube A to be formed. Female die 4 is integrally formed of quenched SKD-11.

Numeral 5 designates a punch having an external shape identical with the internal surface of the tube A to be formed; and the punch 5 is so made that by pressing this punch 5 into a female die, the ring shape aluminum 6 element loaded into the female die 4 is extended, thereby press-forming the aluminum tube A.

Thus the corner portion 4*c*, best seen in FIG. 1, which joins the shoulder portion 4*a* with the drum part 4*b* in the internal shape of the aforementioned female die 4 is formed in a smooth arc. Punch 5 is so formed as to have its maximum diameter portion 5*b* approaching the drum part 4*b* under the arc shape corner portion 4*c* of the aforementioned female die 4 as punch 5 being pressed in the female die 4. Furthermore, the shoulder portion 4*a* of female die 4 and the shoulder portion 5*a* of punch 5 are so formed that the space S therebetween is maximized at the portion S, above the maximum diameter portion 5*b* of the aforementioned punch. See FIG. 4.

It should be noted that the part below the maximum diameter portion 5*b* of the aforementioned punch is formed to have a somewhat smaller diameter.

When manufacturing an aluminum tube by use of the aforementioned device, aluminum is extended by pressing the punch 5 into the female die 4, after loading aluminum ring element 6 therein, thereby drawing-forming the aluminum tube A. At this time, since the corner portion 4*c* which joins the shoulder portion 4*a* with the drum part 4*b* in the internal shape of female die 4 is formed in a smooth arc, the flow of the material as it is being extended is smooth. Moreover, shoulder portion 4*a* of female die 4 and shoulder part 5*a* of punch 5 are formed, e.g. by undercutting, such that the space S therebetween is maximized at the part S1 above the maximum diameter portion 5*b* of the aforementioned punch. Due to this geometry, as the aluminum in the aforementioned space S is pressed by the shoulder portion of the punch 5, the material placed above the shoulder portion is compressed at first, to be squeezed into the space under the shoulder; as a consequence, the aluminum is smoothly squeezed from above successively, thereby making it possible to relieve the compressive pressure inside the space S. Furthermore, because the corner portion 4*c* which joins the shoulder portion 4*a* and the drum part 4*b* in the internal shape of the female die 4 is formed in a smooth arc, the smooth flow of the material is further promoted, thereby making it possible to relieve loads on every part of the device. As a result, the service lives of the female die 4 and the punch 5 can be prolonged, with the female die 4 being integrally formed of such a material as SKD-11, which is relatively low-priced and highly material.

The aluminum tube manufactured in this way is printed or coated with a resin in the next process, to be a completed product of aluminum tube with a mouth portion coating which is separately formed laminated at its mouth portion and its bottom closed around. The completed tube body has a uniform, smooth surface, without being subjected to any forcible extension or uneven compression. Furthermore, since the corner portion 6 which joins the shoulder portion 2 and the drum part 3 is formed in a smooth arc in this completed tube A, any lubricant coated on the female die for facilitating the extension of the material at the time of its drawing-forming does not remain on the sharp portion, unlike the usual cases. Accordingly, the tube surface may be readily printed or coated with a resin and the design of the metal tube can be finished soft.

Figure 2:
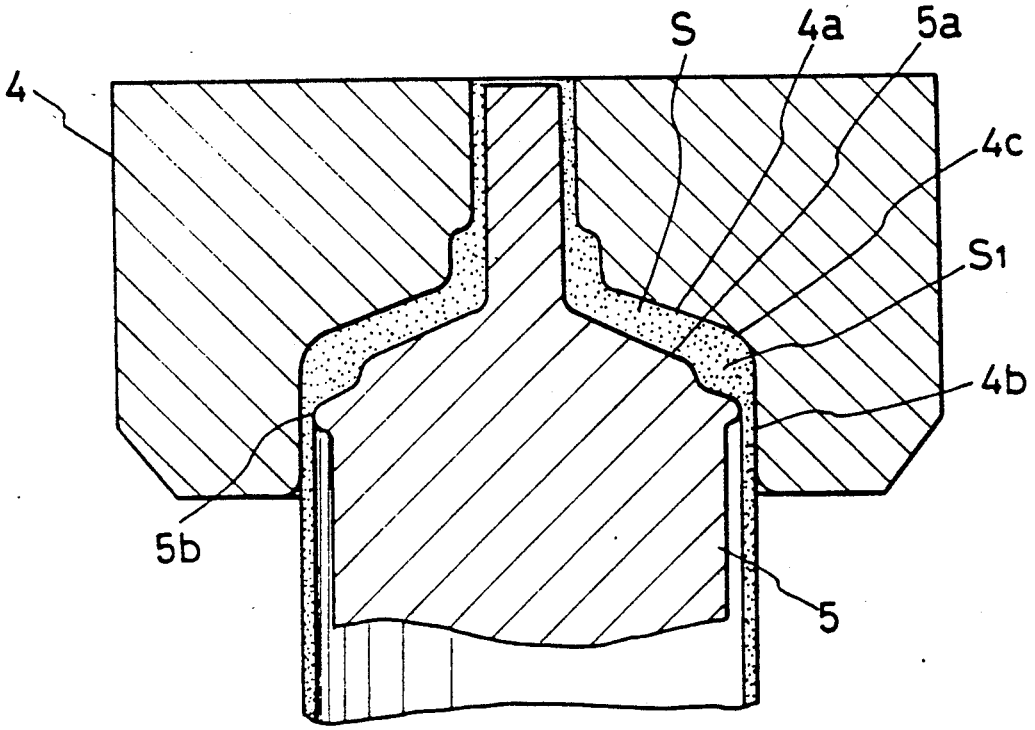
FIG. 2 is a sectional view showing a state in which a tube is being manufactured.
Figure 4:
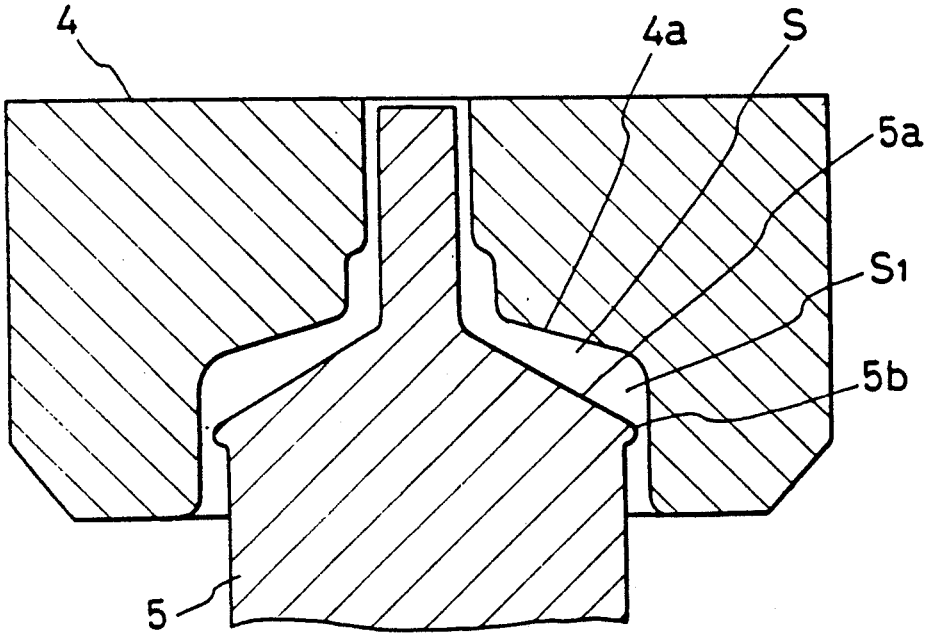
FIG. 4 is a sectional view similar to FIG. 3 showing another embodiment of this invention.

While in the aforementioned embodiment shown in FIGS. 1 and 2, a portion above the maximum diameter portion 5*b* of the punch 5 is cut off, so that the space S formed between the shoulder portion 4*a* of the aforementioned female die 4 and the shoulder portion 5*a* of the punch 5 is maximized at the part above the maximum diameter portion 5*b* of the punch, instead of this configuration, the shoulder portion 5*a* of the punch 5 may be formed with a steeper bevel than the slope of the female die 4, thereby maximizing the aforementioned space S at the part above the maximum diameter portion 5*b* of the punch.

Although typical preferred embodiments of this invention have been described in the foregoing, this invention is not limited to the constructions of the embodiments hereabove-described, but may be practiced with appropriate modifications the device being defined by the claims that follow.

I claim:

1. An aluminum tube manufacturing device, comprising:

a female die, having an internal shape identical with the external shape of an upper part of an aluminum tube to be formed thereby, the female die including a mouth portion, a shoulder portion, and a drum portion for forming corresponding mouth, shoulder, and cylindrical drum parts of said tube; and a punch, having a shoulder portion having an external shape identical with the internal shape of the tube upper part to be formed, for forced extrusion of an aluminum tube by extruding an ring-shaped element of aluminum material loaded in the female die by upward pressing of the punch into the female die, wherein a corner portion which joins the shoulder portion with a drum portion in the internal shape of the female die is formed in a smooth arc, the punch is formed to have a maximum diameter of the shoulder portion thereof approaching a vertical internal surface of the drum portion below the arc shape corner portion of the female die as the punch is being pressed upwardly into the female die, and the shoulder portion of the female die and the shoulder portion of the punch are formed such that an axial spacing therebetween is maximized adjacent the maximum diameter portion of the punch, the punch having a reduced diameter below the maximum diameter portion thereof, the punch is formed such that an upper part of the maximum diameter portion thereof is undercut, and said axial spacing is thereby maximized at the undercut part adjacent the maximum diameter portion of the punch.

2. The aluminum tube manufacturing device according to claim 1, wherein:

the shoulder portion of the punch is formed to have a bevel formed to have a steeper slope than a corresponding slope of the shoulder portion of the female die, whereby said axial spacing is maximized at the part above the maximum diameter portion of the punch with respect to the direction in which the punch is upwardly pressed into the female die.

* * * * *